United States Patent [19]

Gaglione

[11] 4,443,800

[45] Apr. 17, 1984

[54] POLARIZATION CONTROL ELEMENT FOR PHASED ARRAY ANTENNAS

[75] Inventor: Stanley Gaglione, New Hyde Park, N.Y.

[73] Assignee: The United States of America as represented by the Secretary of the Army, Washington, D.C.

[21] Appl. No.: 367,504

[22] Filed: Apr. 12, 1982

[51] Int. Cl.[3] ..... H01Q 3/36

[52] U.S. Cl. ..... 343/372; 343/363; 343/365; 333/21 A; 333/158

[58] Field of Search ..... 333/21 A, 24.1, 24.3, 333/158; 343/854, 363, 365, 372

[56] References Cited

U.S. PATENT DOCUMENTS

| | | | |
|---|---|---|---|
| 2,787,765 | 4/1957 | Fox | 333/21 A |
| 3,698,008 | 10/1972 | Roberts et al. | 333/24.1 X |
| 3,938,158 | 2/1976 | Birch et al. | 333/21 A X |
| 3,982,213 | 9/1976 | Smith et al. | 333/21 A X |
| 4,201,961 | 5/1980 | Klein | 333/24.1 |

OTHER PUBLICATIONS

Roberts, *An X-Band Reciprocal Latching Faraday Rotator Phase Shifter,* Digest of Tech. papers of G-MTT 1970, Int'l. Microwave Symposium, pp. 341-345.

*Primary Examiner*—Paul L. Gensler

*Attorney, Agent, or Firm*—Robert P. Gibson; Anthony T. Lane; Robert C. Sims

[57] ABSTRACT

Each antenna of the phased array is supplied a lineal polarized wave which has been shifted in phase and rotated in polarization in accordance with a cascade connection of a NRCP, Faraday rotator and a RNRCP. The control windings of the Faraday rotator and the rotating polarizer determine the amount of phase shift and rotation of the polarization of the propagating wave.

1 Claim, 14 Drawing Figures

POLARIZATION CONTROL ELEMENT FOR PHASED ARRAY ANTENNAS

DEDICATORY CLAUSE

The invention described herein was made in the course of or under a contract or subcontract thereunder with the Government and may be manufactured, used, and licensed by or for the Government for governmental purposes without the payment to me of any royalties thereon.

SUMMARY OF THE INVENTION

This invention provides for the control of the phase and the angle of the radiated linear polarization from a phased array antenna radiating element. The device consists of a cascade of a non-reciprocal circular polarizer, a Faraday rotator, and a magnetically rotatable non-reciprocal circular polarizer. The control windings for the Faraday rotator and rotatable non-reciprocal circular polarizer are excited by an electronic driver. A linear polarized wave entering the device is converted to a circular polarized wave by the circular polarizer. The Faraday rotator causes the wave to be phase shifted as it propagates through this section of the device. The circular polarizer that is encountered next converts the circular polarized wave back to a linear polarized wave. The angle of the radiated linear polarization is controlled by varying the orientation of the principle axes of the rotatable non-reciprocal circular polarizer. The reciprocal phase shift is produced by a technique similar to that used by a dual mode phase shifter and the rotation is produced by rotating bias fields in a manner similar to that used by a rotary field phase shifter. The phase shift and rotation are produced by a single device as opposed to multiple devices, this leads to lower insertion loss, smaller size, and less weight.

DESCRIPTION OF THE BEST MODE AND PREFERRED EMBODIMENT

Figure 1A:
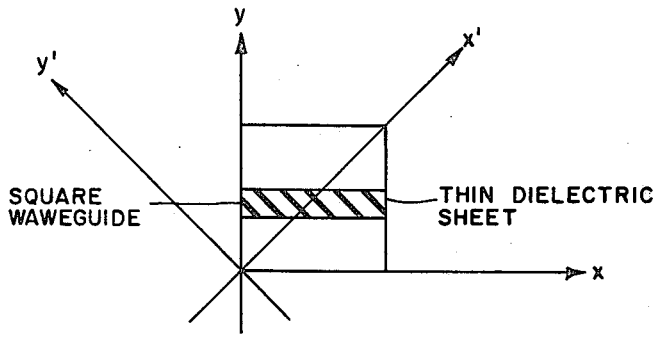
FIGS. 1*a* thru 1*c* illustrate basic circular polarization.
Figure 1B:
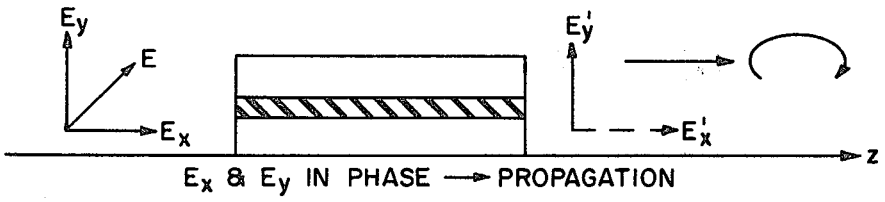
Figure 1C:
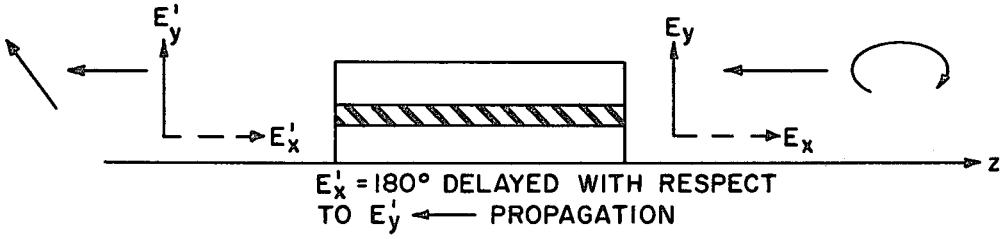

The basic function of all circular polarizers is to convert circular polarization to linear polarizations and linear to circular. The concept can be illustrated by considering the structure shown in FIGS. 1A–1C. The structure consists of a short length of square waveguide with a thin dielectric sheet parallel to one side. The propagation constant of the TE10 mode (E field parallel to y) is slightly less than the propagation constant of the TE01 mode (E field parallel to x) because of the dielectric loading. The x and y axes are referred to as the principle axes, while x′ and y′ are the operating axes.

Linear polarizations incident with the electric field parallel to either principle axis will emerge with the polarizations unchanged. Linear polarization incident at 45° to the principle axes can be resolved into two equal components parallel to the principle axes. If the device length is adjusted so that the phase difference between the two components is 90° at the output, the resulting field is circularly polarized. This occurs because the field components acquire space and time quadrature. The axes at 45° to the x and y axes are referred to as operating axes and the device is also referred to as a quarter wave plate because the phase difference between fields parallel to the principle axes is 90° or $\lambda/4$. The term "plate" comes from an analogy with a similar optical device which looks like a glass plate. The device is reciprocal in the sense that it can be reversed end for end and there will be no difference in the response. Also, if circular polarization is applied to the output with the same sense as the original circular polarization that emerged, the new output will be linear polarization at the same angle that generated the original circular output except that it is propagating in the opposite direction. The above discussion does not consider the effect of discontinuities at the input and output, a perfect match is assumed.

Figure 2:
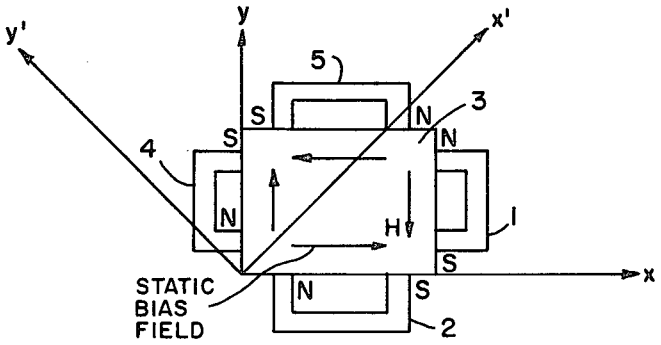
FIG. 2 illustrates a non-reciprocal circular polarizer.

Non-reciprocal circular polarizers have been developed for use with a Faraday rotator to construct a dual mode phase shifter. A sketch of the device is shown in FIG. 2. The transverse bias fields are supplied by small permanent magnets 1, 4, 5, and 2 external to the square waveguide 3. Waveguide 3 is fully filled with ferrite and the permanent magnets 1, 4, 5 and 2 provide a transverse quadrapole field. The x, y represent the principle axes, while the x′, y′ represent the operating axes. The operation of this device can be explained by analogy with a twin slab phase shifter.

Figure 3A:
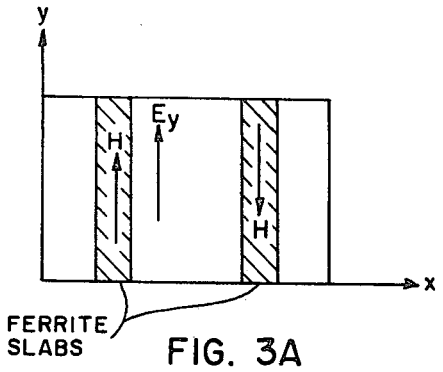
FIGS. 3A and 3B illustrate a twin slab explanation of NRCP.
Figure 3B:
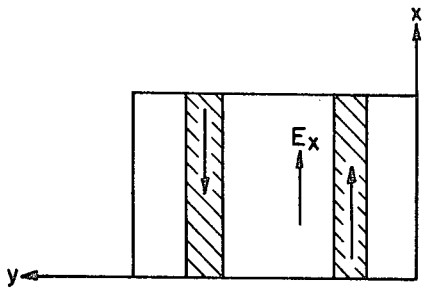
Figure 4A:
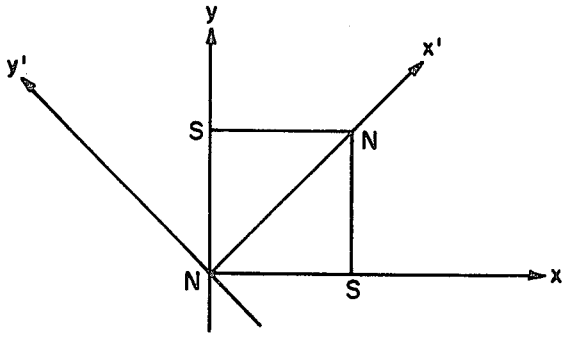
FIGS. 4A through 4C illustrate the operation of NRCP.
Figure 4B:
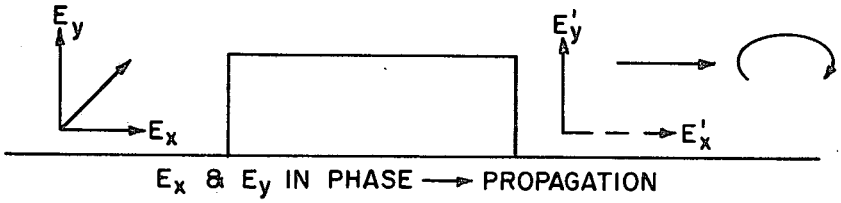
Figure 4C:
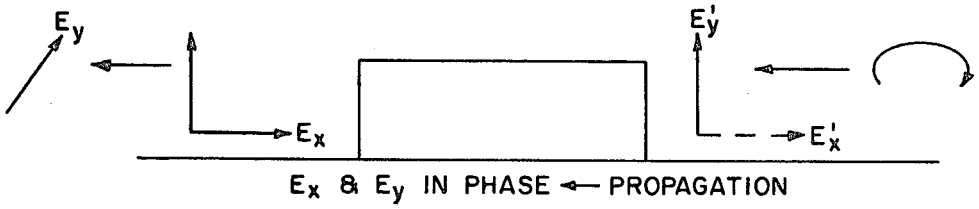

Consider the TE10 mode with the E field parallel to the y axis. This field will experience a non-reciprocal phase shift similar to a twin slab phase shifter as shown in FIG. 3A. Similarily the TE01 mode will experience a phase shift due to the fields shown in FIG. 3*b*. These two bias field conditions correspond to the two maximum remanent magnetic states in a twin slab phase shifter except that they exist simultaneously because of the quadrapole field. Therefore, fields parallel to each of the principle axes will experience differential phase shift as the wave propagates through the device, exactly the same as the reciprocal circular polarizer. The device length can be adjusted so that the differential phase shift is 90° at the output and hence the device converts linear polarization to circular. So far the operation of the non-reciprocal circular polarizer (NRCP) is similar to the reciprocal circular polarizer (RCP), the difference is evident when waves incident in the opposite direction are considered. The sign of the differential phase shift between modes propagating along the principle axes is reversed when the direction of propagation is reversed. That is for the original set of bias fields and propagation direction $E_x$ lags E y by 90° at the output. When the direction of propagation is reversed, the bias fields remaining the same $E_x$ will lead Ey by 90° at the output. The consequence of this non-reciprocal phase shift is shown in FIG. 4C, which should be compared with FIG. 1C.

Figure 5A:
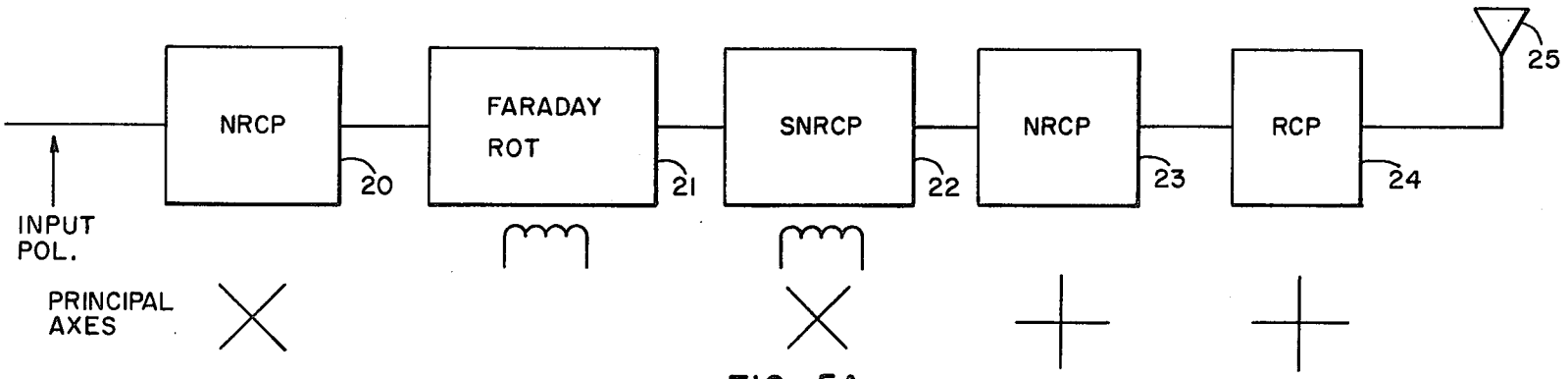
FIG. 5A illustrates the use of SNRCP to select polarization.
Figure 5B:
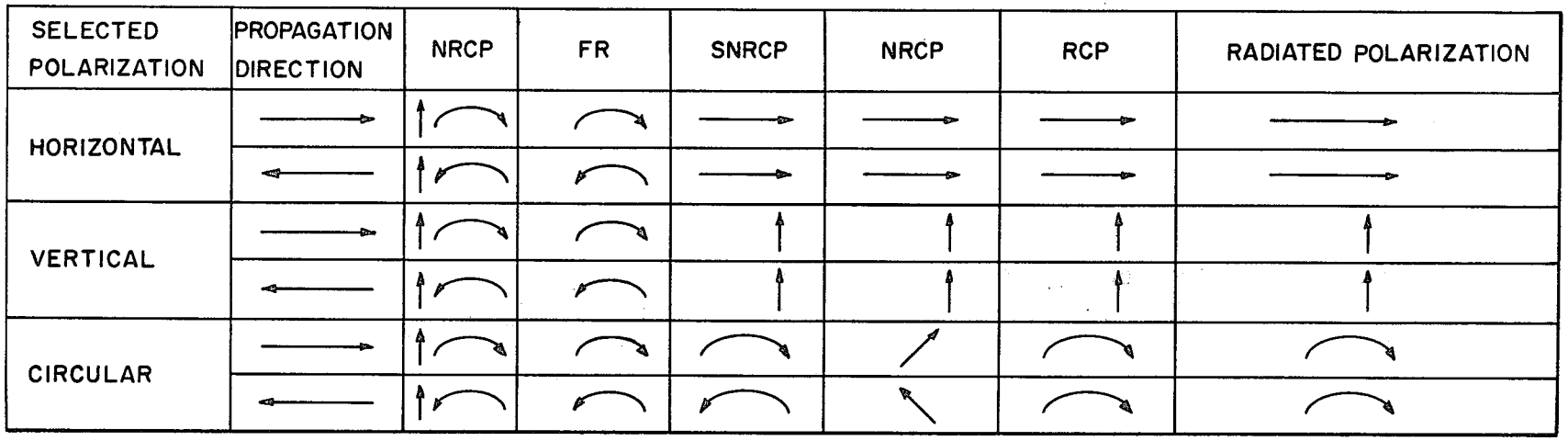
FIG. 5B is a polarization chart of FIG. 5A.

The permanent magnets can be replaced with yokes and coils to make a switchable NRCP (SNRCP). This device can be used to control the sense of circular polarization or the angle of linear polarization. These devices can be combined to build a polarization selectable feed array element. FIG. 5A is a representation of a device which can provide horizontal, vertical and one sense of circular from a single linear polarization input. No mode suppressors or unwanted polarization attenuators are shown. The input polarization is fed through the series connection of NRCP 20, Faraday rotator 21, SNRCP 22, NRCP 23, RCP 24 and antenna 25. FIG. 5B shows the polarization chart for the circuit. Switchable NRCP's cannot be used to perform the compensation required by dome antennas because they can only provide selectable fixed polarizations. Dome antenna compensation requires the ability to provide all polarization over a given range. The basic limitation of the SNRCP 22 in this application is that the control current can only vary the direction of the bias fields and not the angular orientation. Therefore, the principle axes cannot be varied and the output polarization can only be changed 90°. Devices which can change the angular orientation of the principle axes are classified as rotary field devices and are considered below.

Figure 6A:
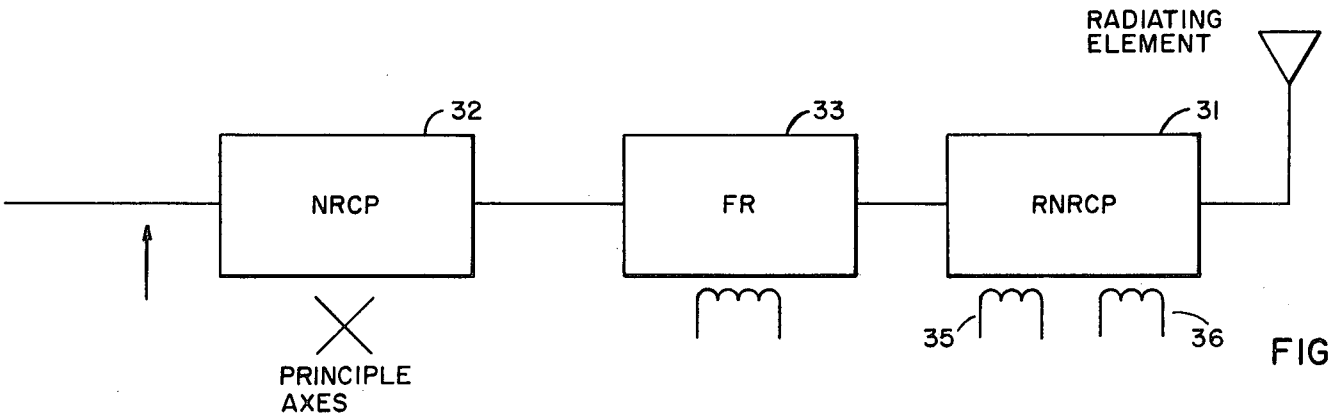
FIG. 6A illustrates a dual mode variable polarization circuit in block form.
Figure 6B:
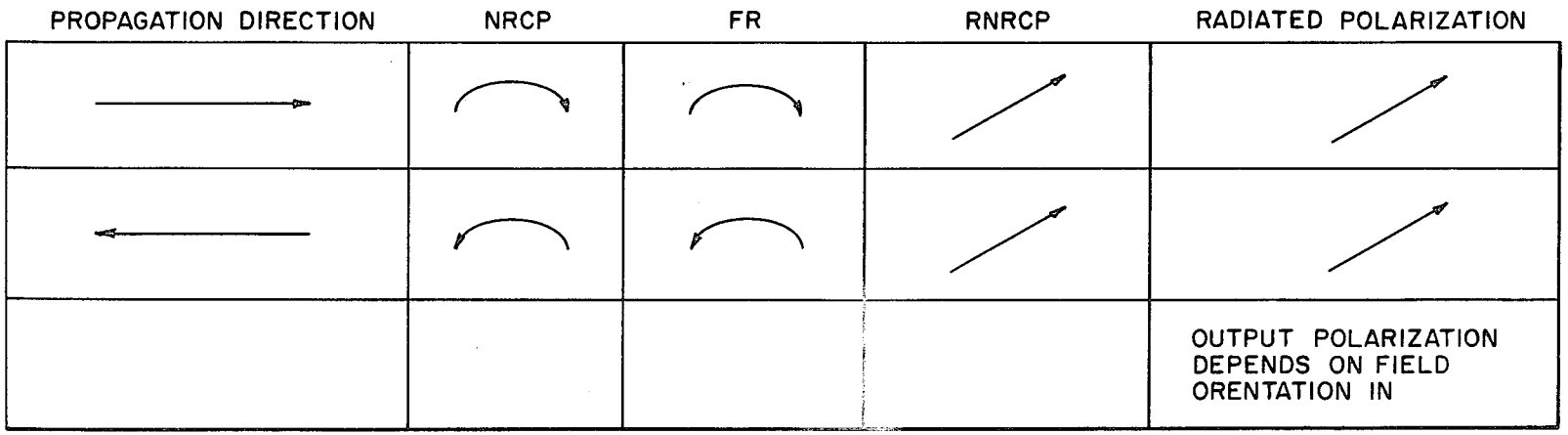
FIG. 6B is a polarization chart of the circuit of FIG. 6A.

Rotary field devices consist of a circular waveguide fully filled with ferrite. The transverse quadrapole flied is provided by a stator (not shown) having slots on which are wound two sets of interlaced coils. The orientation of the quadrapole field and therefore the principle axes of the device are determined by the amplitude relationship of the currents applied to the coils. A rotatable NRCP using this concept (RNRCP) Rotary NRCP) 31 (FIG. 6A) is similar to the center section of a rotary field ferrite phase shifter which is a rotary half wave plate. The RNRCP can be combined with a NRCP 32 and a Faraday rotator 33 to make a dual mode phase shifter with controllable polarization. The phase shift principle is that of the dual mode phase shifter and the polarization control technique is that of the rotary field phase shifter. The RNRCP 31 provides NRCP action for dual mode phase shift and the rotary quadrapole field provides polarization control. FIG. 6A is a representation of the device with a polarization chart, FIG. 6B. Some advantages of the device are: reciprocal operation, simple microwave structure and low loss as compared to the non-reciprocal phase shifter—Faraday rotator combination.

Figure 7:
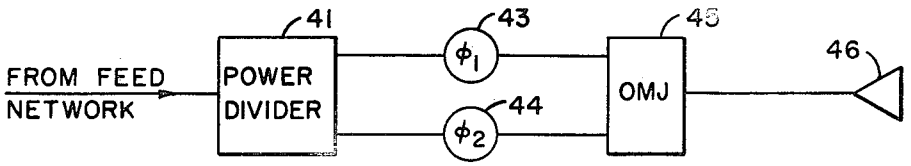
FIG. 7 PRIOR ART
FIG. 7 illustrates a known phased array feed system.

The present invention can be used to control the beam position and the polarization of a phased array antenna. This device can achieve this performance characteristic at a much lower cost than the classical method. The classical method shown in FIG. 7 employs an array of circuits each comprising a power divider 41, two beam steering type phase shifters 43 and 44, an orthogonal mode junction 45 and radiating element 46, as shown in block form by FIG. 7.

The device shown in FIG. 6A provides for the control of the phase and the angle of the radiated linear polarization from a phased array antenna radiating element. The device consists of a cascade of the following elements: A non-reciprocal circular polarizer of conventional design using permanent magnet bias 32, a latching Faraday rotator 33 and rotatable non-reciprocal circular polarizer 31. The rotatable non-reciprocal circular polarizer 31 is a quarter wave plate whose principle axes can be varied by varying the orientation of the applied quadrapole bias field. The bias field is provided by a stator having slots (not shown) in which are wound two sets of interlaced coils 35 and 36. The orientation of the quadropole field and therefore the principle axes of the rotatable non-reciprocal circular polarizer (RNRCP) are determined by the amplitude relationships of the currents applied to the coils. The RNRCP (rotary NRCP) is similar to the center section of a rotary field phase shifter except that it is a quarter wave phate as opposed to a half wave plate. The NRCP, Faraday rotator, and the RNRCP from a dual mode phase shifter, which is a reciprocal device. The RNRCP allows the principle axes of the NRCP used on one end of the device to be varied and therefore the orientation of the radiated polarization.

To summarize the basic concept, the dual mode phase shifter idea is combined with a rotatable non-reciprocal circular polarizer that is similar to the center section of a rotary field ferrite phase shifter to provide a reciprocal phase shifter whose orientation of linear polarization at one end can be varied.

Some advantages of this device are: reciprocal operation (no need to switch between transmit and receive), simple microwave structure, (the basic microwave waveguide can be all one piece) and lower insertion loss because the device will be shorter than the previously described device. The device is shorter because the Faraday rotation of a single ferrite piece is used to provide the phase shift and rotation simultaneously. The previously described device uses the Faraday rotation of a ferrite to provide rotation only. The phase shift is provided by a toroid type phase shifter. This new device also eliminates the need for matching sections between the phase shifter and rotator.

I claim:

1. A polarization control device having an input of a lineal polarized wave and having an output which comprises said lineal polarized wave phase shifted and rotated in a predetermined manner; a non-reciprocal circular polarizer; a Faraday rotator; a rotatable non-reciprocal circular polarizer having first and second control inputs; said polarizers and said rotator being connected in series between the input and the output of said control device; said Faraday rotator having a controlled input; means supplying the inputs of said Faraday rotator and said rotatable polarizer such that the lineal polarized wave will be phase shifted and rotated in polarization to a predetermined amount; a plurality of radiating devices which form a phased array; and a plurality of polarization control devices each connected to one of the radiating devices for individually controlling the phase output of each radiating device.

* * * * *